US005294906A

United States Patent [19]

Totsuka et al.

[11] Patent Number: 5,294,906

[45] Date of Patent: Mar. 15, 1994

[54] FUSIBLE LINK

[75] Inventors: Mitsuhiko Totsuka; Toshiharu Kudo, both of Shizuoka, Japan

[73] Assignee: Yazaki Corporation, Tokyo, Japan

[21] Appl. No.: 29,052

[22] Filed: Mar. 9, 1993

[30] Foreign Application Priority Data

Mar. 25, 1992 [JP] Japan ..... 4-097353

[51] Int. Cl.[5] ..... H01H 85/24

[52] U.S. Cl. ..... 337/260; 337/264; 337/295

[58] Field of Search ..... 337/260, 261, 262, 255, 337/264, 252, 253, 295

[56] References Cited

U.S. PATENT DOCUMENTS 4,224,592 9/1980 Urani et al. ..... 337/260
4,544,907 10/1985 Takano ..... 337/264
4,672,352 6/1987 Takano ..... 337/264
4,800,358 1/1989 Takenouchi et al. .

FOREIGN PATENT DOCUMENTS 61-138150 8/1986 Japan .
63-82347 5/1988 Japan .

*Primary Examiner*—Harold Broome
*Attorney, Agent, or Firm*—Sughrue, Mion, Zinn, Macpeak & Seas

[57] ABSTRACT

Disclosure is a fusible link which prevents a housing from being deformed and discolored due to unnecessary generation of heat in a fuse element. In the fusible link, each of connecting plates includes two elastic engagement pieces and two projections respectively in each of ribs which are formed by folding the two ends of the connecting plate. A housing includes, in the inner wall of a connecting plate insertion hole through which the connecting plate is inserted, a connecting plate slip-off preventive stepped portion to be engaged by the elastic engagement piece and a connecting plate slip-off preventive flange against which the preventive projection is abutted. When the connecting plate is inserted through the connecting plate insertion hole, the engagement portions in the connecting plate are engaged with engagement portions in the housing respectively.

8 Claims, 3 Drawing Sheets

32

FUSIBLE LINK

BACKGROUND OF THE INVENTION

The present invention relates to a fusible link and, in particular, to a fusible link of a cartridge type which is used to protect a power supply circuit for use in a vehicle or the like.

Power supply in a vehicle such as an automobile and the like is normally supplied from its on-board battery and, in order to protect the power supply against a short circuit accident or the like in various electric parts, electric wires and the like, there are provided various kinds of fuses. As a fuse in such a circuit requires a relatively large current, in order to minimize a contact resistance in a connecting portion as well as to secure positive assembly, there has often been used a fusible link of a cartridge type, the connecting terminal plate of which is screwed to an external terminal by use of a bolt and a nut.

Now, in FIG. 7, there is shown a fusible link having a conventional structure and, in FIG. 8, there is shown a fuse element which is applied to the fusible link (Japanese Utility Model Application Sho. 63-82347).

In other words, according to the conventional fusible link 1, simultaneously to when the fuse element 2 shown in FIG. 8 is assembled into a housing 3, a connecting plate 4 forming the fuse element 2 is projected externally of the housing 3.

The assembly or engagement of the fuse element 2 into the housing 3 is achieved in the following manner: that is, for example, there is prepared a U-shaped fuse element having a pair of connecting plates 4; the parts of the respective plate surfaces of the connecting plates 4 are cut and raised to thereby provide two elastic engagement pieces 6 and 7; there is provided in the inner wall of the housing a projection 8 which is shown in FIG. 9 and is disposed so as to correspond to the elastic engagement pieces 6, 7; and, the elastic engagement pieces 6, 7 are engaged with the projection 8. That is, when the fuse element 2 is assemble into the housing 3, the engagement pieces 6, 7 hold and support the side walls of the projection 8 between them.

In the above-mentioned conventional engagement method, one 6 of the engagement pieces 6, 7 prevents the connecting plate 4 from slipping off in the direction of an arrow I shown in FIG. 7 and at the same time the other 7 prevents the connecting plate 4 from slipping off in the direction of an arrow J shown in FIG. 7 and, therefore, the fuse element 2 can be properly fixed to the housing 3.

However, in the above-mentioned conventional structure, since the surface of the connecting plate is cut open in order to provide the elastic engagement pieces, as shown in FIG. 8, the sectional area x—x of the connecting plate, in which these elastic engagement pieces are provided, is smaller than the sectional area y—y of the connecting plate which provides a non-elastic engagement piece region, which results in the increased current density of the region in which the elastic engagement pieces are produced.

As a result of this, an elastic engagement claw region shown by a chained-line ellipsoidal portion b is heated when an excess current flows and also is raised in temperature due to generation of heat from a fusible portion. Such increased temperature of the connecting plate has an influence on the housing which stores the connecting plate therein, with the result that a portion of the housing shown by d in FIG. 7, which corresponds to the ellipsoidal portion b of the connecting plate, is deformed and discolored. In particular, if the housing is deformed, then it is difficult to replace an old fuse element with a new one and to remove the fusible link from a fusible link mounting box, which worsens the operationability of the fusible link greatly.

Also, according to the above-mentioned conventional structure, the fuse element is held at the two positions thereof by the two elastic engagement pieces respectively provided in the surface of each of the connection plates. However, such support is not always sufficient for the movement of the fuse element along the projection shown in FIG. 9, with result that the fuse element plays greatly with respect to the housing.

SUMMARY OF THE INVENTION

In view of the forgoing problems, it is an object of the invention to provide a fusible link which can reduce generation of heat of a connecting plate in the portion thereof for engagement with a housing when an excess current flows to thereby mimize influences on the housing so as to prevent the housing from being deformed and discolored.

Also, it is another object of the invention to provide a fusible link which can enhance the holding force of a fuse element by the housing.

In attaining the above objects, according to the invention, there is provided a fusible link comprising an electrically insulated housing, a fusible portion to be disposed within the housing, and a pair of connecting plates respectively disposed in parallel on the two ends of the fusible part and extending in parallel through connecting plate insertion holes respectively formed in the bottom portion of the housing, in which each of the connecting plates includes on the two side edge portions thereof a projection and an elastic engagement piece for slip-off prevention respectively engageable with an engagement portion provided in the housing to restrict the position of the connecting plate in the insertion direction thereof to thereby secure the connecting plate within the housing.

According to the invention, the engagement means of the fuse element with the housing are provided on the two side edge portions of each of the two connecting plates, that is, there is eliminated such conventional structure in which the surface of the connecting plate to serve as an electric current path is opened up to provide engagement means, so that the sectional area of each of the two connecting plate according to the invention is not reduced. Therefore, the fuse element according to the present invention is able to prevent unnecessary generation of heat due to an increase in a current density.

Also, the engagement means of the fuse element with the housing are formed in the two side edge portions of each of the two connecting plates and thus the fuse element is supported at the four positions thereof with respect to the housing and is restricted in position in all directions respectively perpendicular to the connecting plate insertion direction. This can avoid the possibility that the fuse element can play with respect to the housing.

According to the present invention, A fuse element comprises a pair of connecting plates disposed in parallel and connected through a fusible member; and an engaging device provided on both side edge portions of said connecting plate, respectively, to restrict a position of said connecting plates in the insertion direction thereof.

DETAILED DESCRIPTION OF THE PREFERRED EMBODIMENTS

Description will be hereinbelow given in detail of the embodiments of a fusible link according to the invention with reference to the accompanying drawings.

Figure 1:
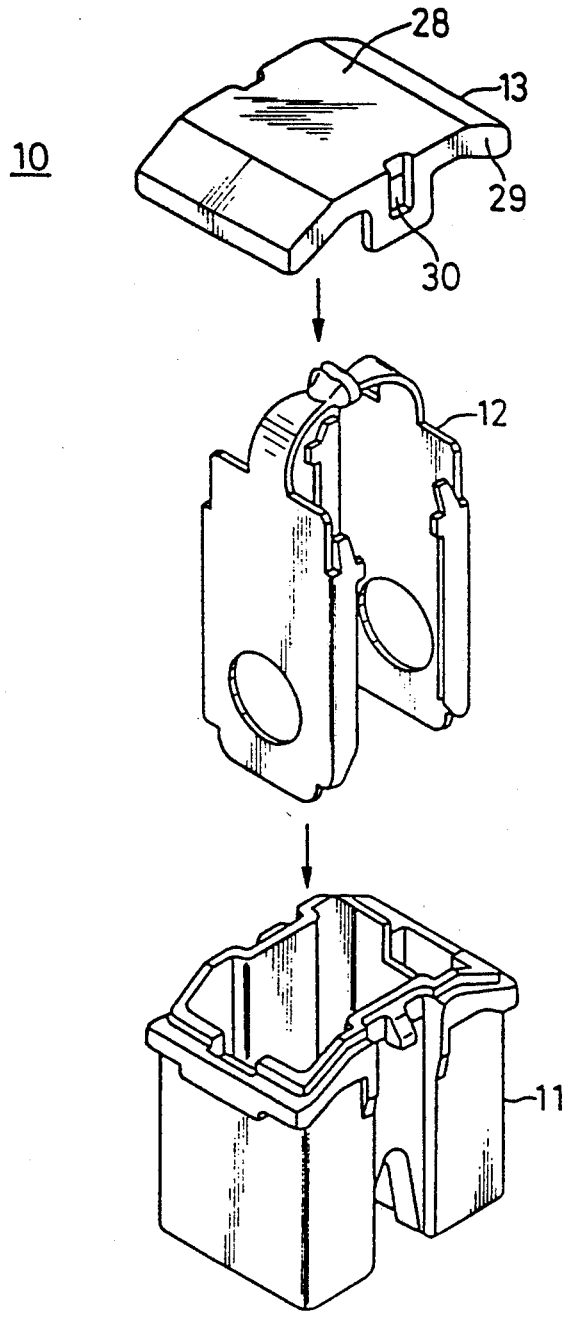
FIG. 1 is an exploded perspective view of a first embodiment of a fusible link according to the invention.

FIG. 1 is an exploded perspective view of a first embodiment of a fusible link according to the invention.

In FIG. 1, the fusible link 10 mainly consists of an electrically insulated housing 11, a fuse element 12 to be stored within the housing 11, and a cover 13 formed of a transparent plastic resin and fittable into the housing 11 with fuse element 12 stored herein.

Figure 2:
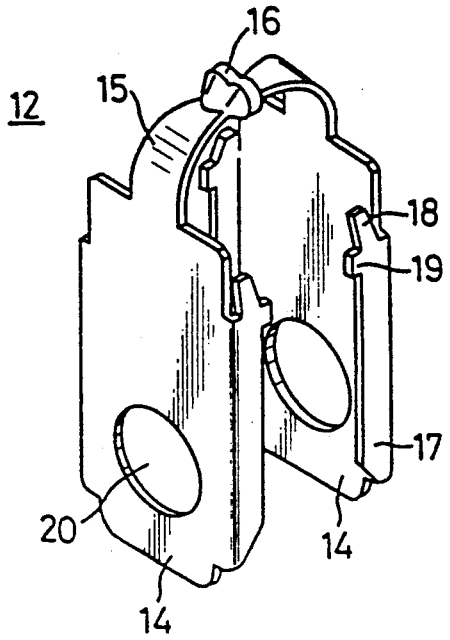
FIG. 2 is a perspective view of a fuse element shown in FIG. 1.

The fuse element 12, as shown in FIG. 2, has a U-shaped structure in which two connecting plates 14 each formed of a substantially flat plate are respectively connected to the two ends of a fusible portion 16 through curved portions 15 each narrower in width than each connecting plate to provide a curved U-like from with the fusible portion 16 as the vertex thereof. The two connecting plates 14 are respectively projected out in parallel from the bottom portion of the housing.

The two connecting plates 14 are respectively made of a low fusing point metal and the two side edge portions of the surfaces of the connecting plates opposed to each other are slightly folded inwardly to thereby provide ribs 17 respectively. Also, each of the ribs 17 includes, in the end portion thereof close to the side of the fusible portion, an elastic engagement piece 18 to function as a slip-off preventive member when the connecting plate 14 is inserted into the housing 11 as well as a projection 19 to serve as a restrict member for restricting the position of the connecting plate in the insertion direction thereof. Further, each of the connecting plates 14 includes, in the portion of the surface thereof disposed nearer to the leading end thereof when it is projected out from the housing bottom portion, a through hole 20 through which is inserted a bolt for connecting a conduction cable.

The elastic engagement piece 18 is formed in such a manner that the leading end thereof on the side of the fusible portion is opened or formed as a free end. At the same time, the elastic engagement piece 18 is inclined such that the elastic engagement piece 18 and the free end thereof respectively formed on the same plate surface are made to approach each other. As a result of this, when the connecting plate 14 is assembled into the housing, the elastic engagement piece 18 can be abutted against the inner wall of the housing and thus can be deformed elastically. On the other hand, the projection 19 is provided in such a manner that in the base portion of the elastic engagement piece 18 a part of the rib 17 is projected out toward the opposed connecting plate.

Figure 3:
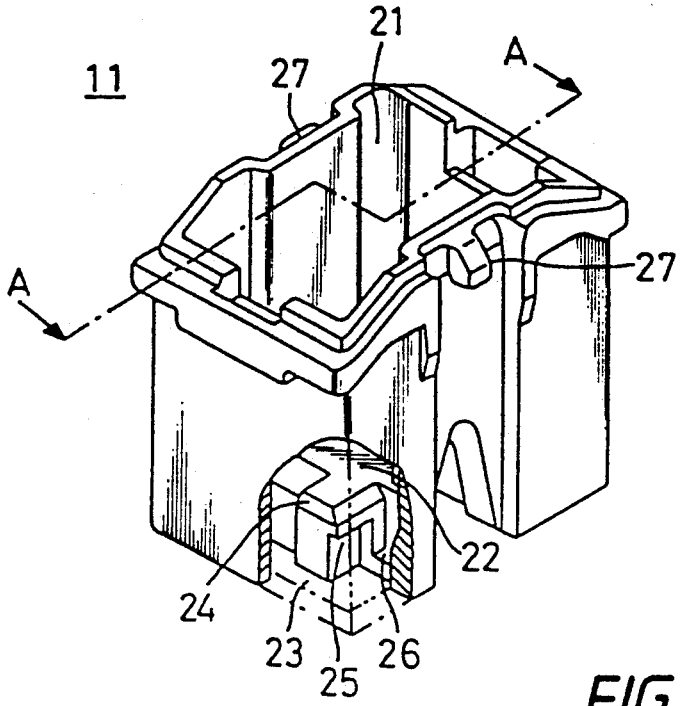
FIG. 3 is a partly cut-away perspective view of a housing shown in FIG. 1.

FIG. 3 is a partly broken perspective view of the housing 11. The housing 11 is produced by injection forming a heat resisting resin. The housing 11 includes, in the upper half section thereof having a depth substantially equal to one half of the height of the housing, a space 21 which has a rectangular opening so as to store the fusible portion 16 therein. Also, the housing 11 includes, in the bottom portion 22 thereof which defines the space 21, a pair of connecting plate insertion holes 23 through which the connecting plate 14 is inserted. In the housing 11, the area of the bottom portion 22 adjoining the connecting plate insertion hole 23 is formed as an inclined surface 24 and, at the same time, in the inner wall of the connecting plate insertion hole 23 corresponding to the inclined surface 24, there are provided a connecting plate slip-off preventive stepped portion 25 acting as the engagement portion of the connecting plate 14 to be inserted, and a connecting plate slip-off preventive flange 26 disposed in the opening end of the bottom portion from which the connecting plate 14 is guided out. Further, in the housing 11, a set of cover engagement projections 27 are provided in the rectangular outer peripheral edges of the space 21 which is opened up so as store the fuse element 12.

Referring back to FIG. 1, the cover 13 is formed by injection molding, and mainly consists of a substantially rectangular cover portion 28 to cover the space 21 when it is fitted over the housing 11 and an engagement ring 30 disposed in the peripheral wall 29 of the cover portion 30 and engageable with the cover engagement projection 27 when the latter is inserted.

Next, description will be given below of a fusible link according to the invention which is composed of the various members respectively constructed in the above-mentioned manner.

Figure 4:
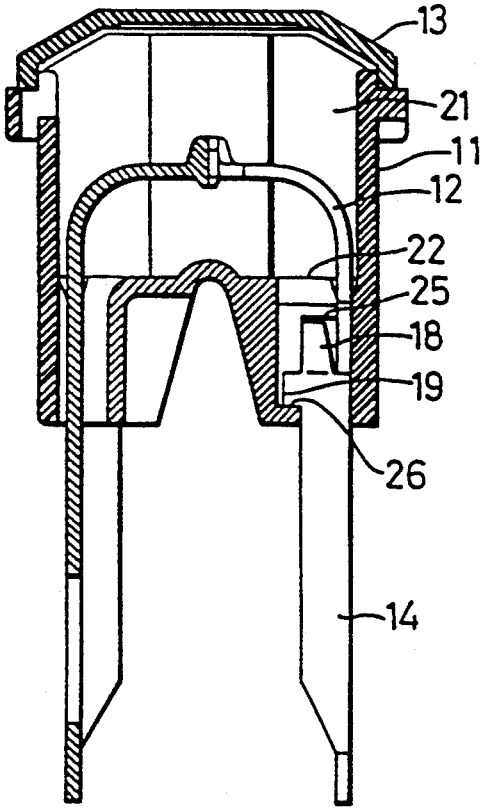
FIG. 4 is a longitudinal section view of a fusible link according to the invention.
Figure 5:
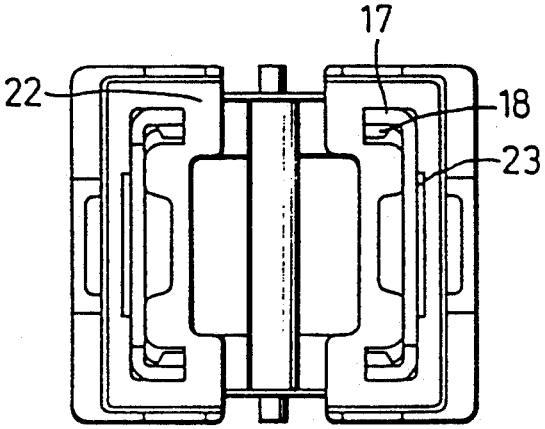
FIG. 5 is a bottom plan view of the above fusible link where the fusible element is disposed within the housing.

FIG. 4 is a longitudinal section view of a fusible link with a fuse element stored in a housing, which corresponds to a section of the housing taken along the line A—A shown in FIG. 3. FIG. 5 is a bottom view of the fusible link.

As shown in FIGS. 4 and 5, in the fuse element 12, at the same time when the fusible portion 16 is stored within the space 21 of the housing 11, the leading end portion of the connecting plate 14 is guided through the connecting plate insertion hole 23 by use of the inclined surface 14 of the housing bottom portion 22 and is then projected out from the opening end of the bottom portion 22.

In a step of assembling the fuse element 12 into the housing, if, while the elastic engagement piece 18 is abutted against the inner wall surface of the connecting plate insertion hole 23 and is elastically deformed, the projection 19 is abutted against the connecting plate slip-off preventive flange 26 at the opening end of the housing bottom portion and is secured at a give position, then simultaneously with this, the elastic engagement piece 18 is also engaged with the connecting plate slip-off preventive stepped portion 25.

. In other words, due to the fact that the elastic engagement piece 18 is engaged with the connecting plate slip-off preventive stepped portion 25 and is thus prevented from slipping off and the projection 19 is abutted against the connecting plate slip-off preventive flange 26 and is thus restricted in position in the insertion direction thereof, the fuse element 12 is prevented from slipping off from the housing and can be strongly fixed to the housing.

Next, the cover engagement projection 27 is inserted into the engagement ring 30 of the cover 13 to thereby fit the cover 13 over the housing 11 and thus combine them into an integral unit. After then, the fusible link 10 is mounted to a fusible link mounting box (not shown) and a conduction cable is connected thereto by means of the through hole 20.

The fusible link 10 constructed in the above-mentioned manner may be exchanged with a new fusible link 10 when an excess current exceeding a steady-state current value flows in the fuse element 12 and fuses and cuts the fusible portion 16.

Figure 6:
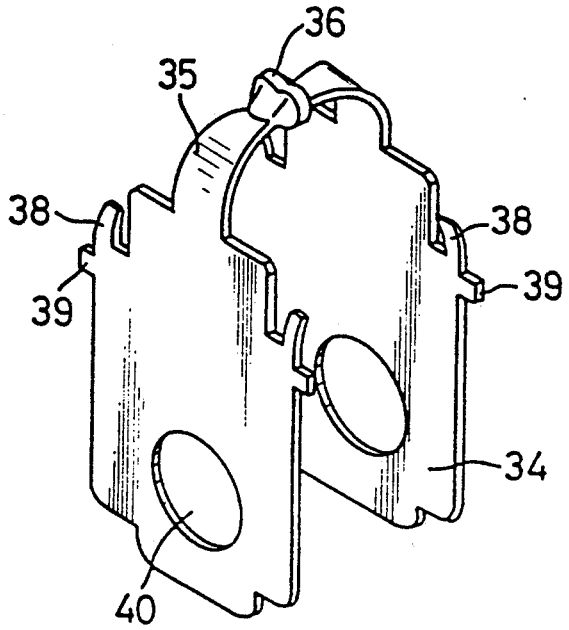
FIG. 6 is a perspective view of a second embodiment of a fusible link according to the invention.
Figure 7:
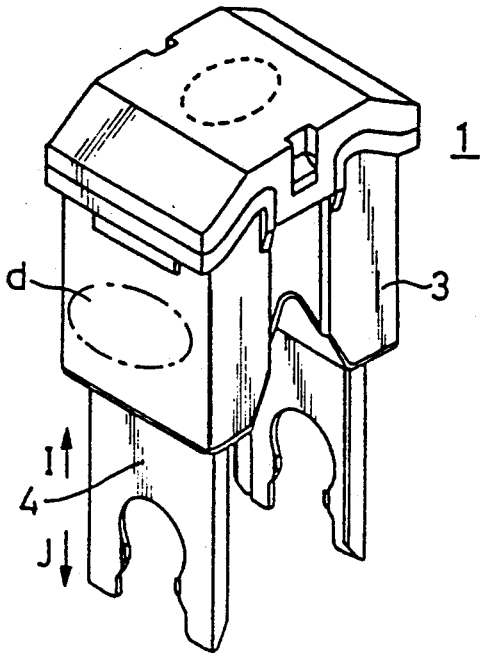
FIG. 7 PRIOR ART
FIG. 7 is a perspective view of a conventional fusible link.
Figure 8:
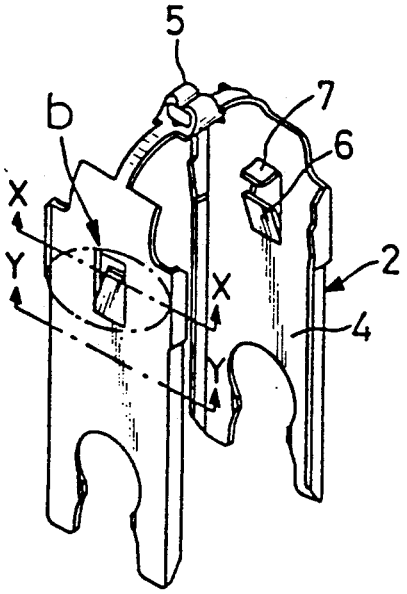
FIG. 8 PRIOR ART
FIG. 8 is a perspective view of a fuse element to be applied to the fusible link shown in FIG. 7.
Figure 9:
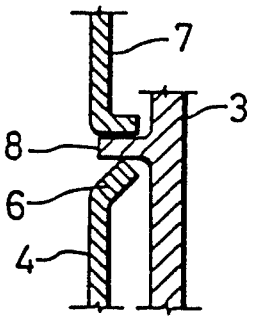
FIG. 9 PRIOR ART
FIG. 9 is a partially section view used to explain engagement between a fuse element and a housing of a conventional structure.

Referring now to FIG. 6, there is shown another embodiment of a fuse element which is applied to the invention. This fuse element 32, similarly to the previously described embodiment shown in FIG. 2, includes two connecting plates 34 which are respectively formed in a substantially flat plate and are respectively connected to the two ends of a fusible portion 36 through narrow curved portions 35. The fuse element 32 is formed in a U shape curved with the fusible portion 36 as a vertex.

Each of the connecting plates 34 includes, in the respective ends of the two side edge portions thereof on the side of the fusible portion, an elastic engagement piece 38, which acts as a slip-off preventive member when the connecting plate 34 is inserted into the housing, and a projection 39 which acts as a position restrict member in the insertion direction of the connecting plate 34. Also, the connecting plate 34 includes, in the surface thereof disposed nearer to the leading end thereof when it is projected out from the housing bottom portion, a through hole 40 through which a bold for connecting a conduction cable is inserted, similarly to the previously described embodiment.

The elastic engagement piece 38 is formed as a free end with its leading end on the side of the fusible portion opened and the free end is inclined toward the mutually opposing connecting plates, so that when the connecting plate 34 is assembled into the housing, the elastic engagement piece 38 is abutted against the inner wall of the housing and is thus elastically deformed. On the other hand, the projection 39 is formed by projecting out externally a part of the connecting plate 34 in the base portion of the elastic engagement piece 38. The housing (not shown) includes, in the inner wall of the connecting plate insertion hole thereof, engagement portions with which the elastic engagement piece 38 and projection 39 are engageable respectively, similarly to those in the previously described embodiment shown in FIG. 3.

Also, in the illustrated embodiments of the invention, the elastic engagement piece is inclined in a specified direction. However, the invention is not limited to this, but the free end of the elastic engagement piece may be inclined in the opposite direction.

As has been described heretofore, according to the invention, due to the fact that, in engagement between a fuse element and a housing, engagement means to be provided in the fuse element are formed in ribs respectively provided in the two ends of a connecting plate, there is eliminated the possibility that the sectional area of the connecting plate is reduced to thereby increase a current density, as in the conventional structure. This prevents generation of heat at more than a predetermined temperature to reduce ill effects on the housing. That is, this can prevent the housing from being deformed and discolored.

Also, according to the invention, the engagement means of the fuse element is achieved by a four-position-support mechanism which comprises elastic engagement pieces and projections respectively provided in four ribs, as well as connecting plate slip-off preventive stepped portions and connecting plate slip-off preventive flanges respectively provided in the housing. Thanks to this, the fuse element and housing can be strongly fixed to each other, without producing any play between them.

On the other hand, according to the present invention, the fuse element is designed to separelty only use for vehicle, only.

What is claimed is:

1. A fusible link assembly comprising:

a fuse element including:

a pair of connecting plates disposed in parallel and interconnected through a fusible member, said connecting plates being planar and defined by outer edge portions; and engaging means for positioning said connecting plates in a predetermined position so that said connecting plates are restricted from moving in an insertion direction, said engaging means being provided only on said edge portions; and a housing including:

a receiving device for receiving said engaging means to fix said fuse element thereon, said receiving device being mounted on a bottom portion of said housing.

2. A fusible link assembly as claimed in claim 1, wherein said receiving means includes a connecting plate slip-off preventive flange and a connecting plate slip-off preventive stepped portion.

3. A fusible link assembly as claimed in claim 1, wherein said engaging means includes an elastic engagement piece engaged with said connecting plate slip-off preventive stepped portion and a projection abutted against said connecting plate slip-off preventive flange and said elastic engagement piece is inclined to secure the engagement of said fuse element.

4. A fusible link assembly as claimed in claim 1 further comprising:

a cover fitted over said housing.

5. A fusible link as claimed in claim 1, wherein said engaging means includes ribs defined in such a manner that side edge portions of said connecting plate oppose each other are folded inwardly in an L-shape, a pair of projections project from said connecting plate, and said projections are inclined inwardly to confront each other.

6. A fuse element adapted to be secured in a housing by pushing said fuse element in an insertion direction into said housing, comprising:

a pair of connecting plates disposed in parallel and connected through a fusible member, said connecting plates being defined by side edge portions; and engaging means provided only on said side edge portions of said connecting plates to prevent movement of said connecting plates in the insertion direction thereof.

7. A fuse element as claimed in claim 6, wherein said engaging means includes an elastic engagement piece and a projection, said elastic engagement piece is inclined to secure the engagement of said fuse element thereof.

8. A fust element as claimed in claim 6, wherein said engaging means includes ribs define in such a manner that side edge portions of said connecting plate opposed each other are folded inwardly, and a pair of projections are projected from said connecting plate, and said projections are inclined inwardly to confront each other.

* * * * *